United States Patent [19]

Tsacoyannis

[11] 4,123,051

[45] Oct. 31, 1978

[54] EDUCATIONAL GAME

[76] Inventor: Hedwig R. Tsacoyannis, 110 E. End Ave., New York, N.Y. 10028

[21] Appl. No.: 819,953

[22] Filed: Jul. 28, 1977

[51] Int. Cl.[2] ..... A63F 9/00

[52] U.S. Cl. ..... 273/1 R; 35/35 J; 273/144 R; 273/148 A; 273/272

[58] Field of Search ..... 273/1 R, 1 E, 1 M, 272; 35/35 R, 35 J

[56] References Cited

U.S. PATENT DOCUMENTS

| | | | |
|---|---|---|---|
| 1,512,147 | 10/1924 | Tegmeyer et al. | 273/272 |
| 2,380,106 | 7/1945 | Hilton | 273/272 X |
| 3,393,914 | 7/1968 | Hill | 273/272 |
| 3,606,336 | 9/1971 | Krause | 273/272 |

FOREIGN PATENT DOCUMENTS

| | | | |
|---|---|---|---|
| 1,208,246 | 9/1959 | France | 273/272 |

*Primary Examiner*—Paul E. Shapiro

[57] ABSTRACT

An educational game including a plurality of category cards each defining a category of items, a plurality of reference cards which list alphabetically items to be found in each category on the category cards, a plurality of score cards, a plurality of markers each having a letter of the alphabet thereon and a timer. One of the markers is selected along with one of the category cards. The players are then permitted to write down all the items they can think of in the category on their score cards within a preselected interval of time. The items in the selected category are written in alphabetical order beginning with the letter appearing on the selected marker.

6 Claims, 5 Drawing Figures

Fig. 5.
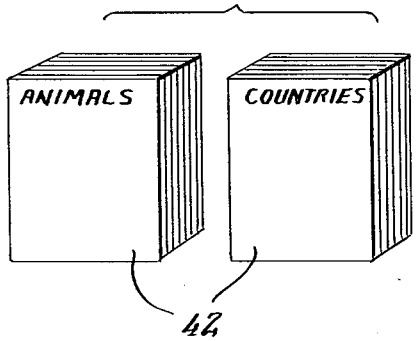
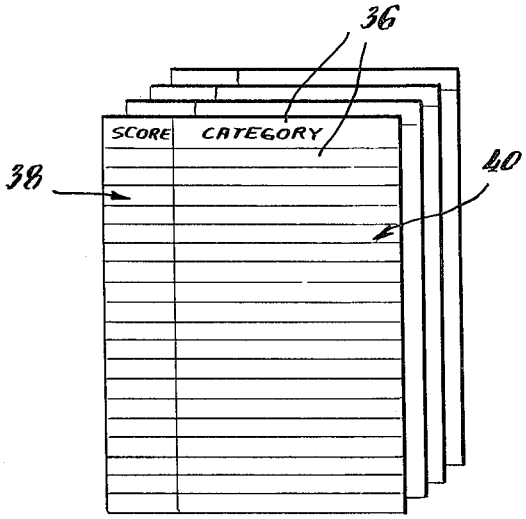
Fig. 4.
Fig. 1.
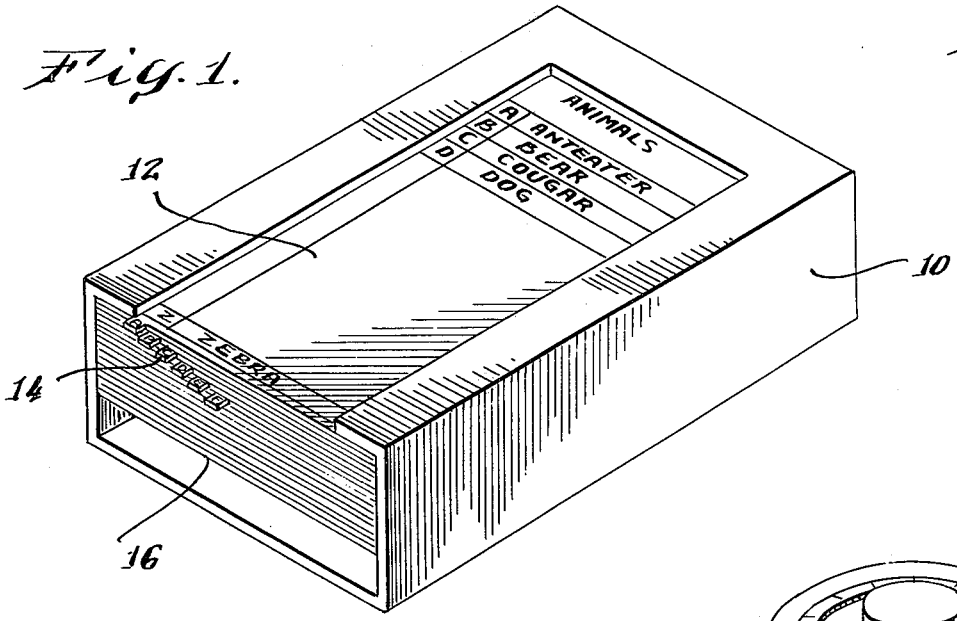
Fig. 2.
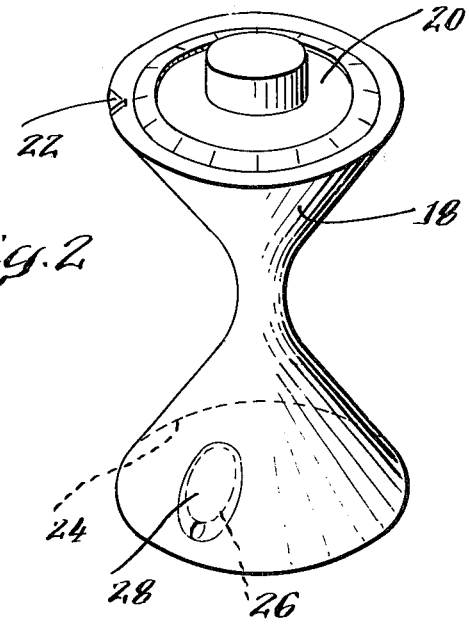
Fig. 3.
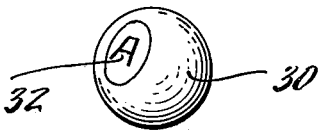

EDUCATIONAL GAME

BACKGROUND OF THE INVENTION

1. Field of the Invention

The present invention relates to educational games, and more particularly to an educational game wherein a category of items are defined by reference cards and the categories and the items within the categories are attempted to be listed by the players in alphabetical order.

2. Description of the Prior Art

The prior art abounds with educational games which use combinations of words, letters, and symbols for various types of play. Typical of the apparatuses known in the prior art are U.S. Pat. Nos. 1,512,147, 1,591,639, 2,167,915, 3,655,195, 3,746,342, 3,396,972, 3,480,278, and 3,411,211. All the above listed inventions use various combinations of letters where lists of words and symbols are used in play to accomplish the ends of a word game. In contrast to the prior art the present invention provides an educational game wherein categories are defined by a plurality of category cards and the players are challenged to list items within that category in alphabetical order beginning with a letter selected by a plurality of markers. In the event that the players cannot think of items within the category they are permitted to refer to reference cards which list the items.

SUMMARY OF THE INVENTION

Therefore, a primary object of the present invention is to provide an educational game wherein the players are challenged to think of a plurality of items disposed within a defined category.

A still further object of the present invention is to provide an educational game wherein reference cards are provided so that in the event a player cannot think of items within a category he may refer to the reference cards for the correct answers.

A still further object of the present invention is to provide an educational game which improves the word recognition and vocabulary of the users.

Still another object of the present invention is to provide an educational game which is played with a minimum number of rules and which is simple to teach to beginners.

Still another further object of the present invention is to provide an educational game which is simple in design, inexpensive to manufacture and durable.

These objects, as well as further objects and advantages of the present invention will become readily apparent after reading the description of a non-limiting illustrative embodiment and the accompanying drawing.

An educational game according to the principles of the present invention includes a plurality of category cards each having indicia thereon defining a category of items; a plurality of reference cards, one of the reference cards corresponding in category to each of the category cards, each of the reference cards having indicia disposed thereon listing a plurality of items disposed in the category associated therewith, the plurality of items being arranged in alphabetical order; a plurality of scorecards having indicia disposed thereon dividing the scorecards to facilitate the writing of items thereon; a plurality of markers each having a letter of the alphabet disposed thereon; and means for timing a preselected interval of time.

BRIEF DESCRIPTION OF THE DRAWING

In order that the invention may be more fully understood, it will now be described, by way of example, with reference to the accompanying drawing in which:

FIG. 1 is a perspective view of the reference cards and the housing therefor of the present invention;

FIG. 2 is a perspective view of the timer of the present invention;

FIG. 3 is a perspective view of one of the markers of the present invention;

FIG. 4 is a front view of the plurality of scorecards of the present invention; and FIG. 5 is a perspective view of the category cards of the present invention.

DESCRIPTION OF THE PREFERRED EMBODIMENT

Referring now to the figures, and more particularly to FIG. 1 thereof, there is illustrated therein an open ended housing 10 having a plurality of reference cards 12 disposed therein. The reference cards are stacked and are preferrably divided by alphabetized dividers 14. The reference cards 12 are maintained in a stacked position by a spring loaded plate 16 disposed within the open ended housing 10. The spring loaded plate 16 may be urged by any suitable spring means well known in the art.

FIG. 2 illustrates a timer 18. The timer 18 is of the wind-up type and may be set for various time intervals on a dial 20 indexed by a pointer 22. The base of the timer forms a storage chamber 24 therein which is accessible through an aperture 26 covered by a pivotal flap 28. The storage chamber 24 is provided for the storage of a plurality of markers 30, as illustrated in FIG. 3. Markers 30 and the aperture 26 correspond in size so that only one marker 30 may be dispensed through the aperture 26 at a time. The mechanism of the timer 18 is such that the maximum time to be set thereon is 60 seconds.

The marker 30 shown in FIG. 3 is preferrably cylindrical in shape and includes indicia 32 thereon representing a letter of the alphabet. The present invention includes 26 such markers 30 each with a different letter of the alphabet disposed thereon.

FIG. 4 illustrates the scorecards 34 of the present invention. The scorecards have indicia 36 disposed thereon dividing the cards into a score column 38 and a category column 40. FIG. 5 illustrates a plurality of category cards 42. Each of the category cards 42 has indicia thereon defining a category of items. Typical categories of items might include things in the home, historical figures, cars, countries, flowers, cities, fruits, vegetables, rivers, oceans, lakes, animals, tools, machinery, and trees.

The present invention is played by each player receiving one of the scorecards 34. One of the category cards is then selected at random. A marker 30 is then selected. If, for example, the category card labeled is selected and the marker having a B thereon is selected then the play of the game would be concerned with animals in alphabetical with the letter B. The timer 18 is set for 60 seconds and each player much then list the animals he can think of beginning with the letter B and proceeding through the alphabet, within the 60 second time limit. If a player cannot think of an animal who's name begins with a particular letter he may then refer to the reference cards 12. After the 60 second play is completed the scoring is effected by assigning five points for each answer which is correct that was thought of by the player and 1 point for each correct answer which was copied from the reference card. The player with the highest score is the winner and then another category card 42 is selected and the play of the game continues.

Therefore, a primary advantage of the present invention is to provide an educational game wherein the players are challenged to think of a plurality of items disposed within a defined category.

A still further advantage of the present invention is to provide an educational game wherein reference cards are provided so that in the event a player cannot think of items within a category he may refer to the reference cards for the correct answers.

A still further advantage of the present invention is to provide an educational game which improves the word recognition and vocabulary of the users.

Still another advantage of the present invention is to provide an educational game which is played with a minimum number of rules and which is simple to teach to beginners.

Still another further advantage of the present invention is to provide an educational game which is simple in design, inexpensive to manufacture and durable.

It will be understood that various changes in the details, materials, arrangements of parts and operating conditions which have been herein described and illustrated in order to explain the nature of the invention may be made by those skilled in the art within the principles and scope of the invention.

Having thus set forth the nature of the invention, what is claimed is:

1. An educational game comprising in combination:

a plurality of category cards each having indicia thereon defining a category of items;

a plurality of reference cards, one of said reference cards corresponding in category to each of said category cards, each of said reference cards having indicia disposed thereon listing a plurality of items disposed in the category associated therewith, said plurality of items being arranged in alphabetical order;

a plurality of score cards having indicia disposed thereon dividing said score cards to facilitate the writing of items thereon;

a plurality of markers each having a letter of the alphabet disposed thereon; and means for timing a preselected interval of time.

2. An educational game in accordance with claim 1, wherein said timing means comprises a 60 second timer disposed within a housing.

3. An educational game in accordance with claim 2, wherein said timer further comprises a storage chamber therein for storing said plurality of markers and means for dispensing said markers from said storage chamber one at a time.

4. An educational game in accordance with claim 1, further comprising means for storing, indexing, and selectively dispensing said reference cards.

5. An educational game in accordance with claim 4, wherein said storing, indexing, and selective dispensing means comprises an open ended housing dimensioned to accommodate said reference cards therein, a plurality of alphabetized dividers for indexing said housing, and means for selectively retaining said reference cards within said housing.

6. An educational game in accordance with claim 5, wherein said selective retaining means comprises a spring loaded plate within said housing, said spring loaded plate functionally engaging said reference cards.

* * * * *